US007290296B1

(12) United States Patent
Wilson

(10) Patent No.: US 7,290,296 B1
(45) Date of Patent: Nov. 6, 2007

(54) PORTABLE TRAVEL POTTY

(76) Inventor: Verbateen Wilson, 219 13th St., #8, Brooklyn, NY (US) 11215

( * ) Notice: Subject to any disclaimer, the term of this patent is extended or adjusted under 35 U.S.C. 154(b) by 392 days.

(21) Appl. No.: 10/987,325

(22) Filed: Nov. 12, 2004

(51) Int. Cl.
*A47K 11/04* (2006.01)

(52) U.S. Cl. ..... 4/484; 4/479; 4/902

(58) Field of Classification Search ..... 4/483–484, 4/479–480, 902; 340/686, 545.6, 689
See application file for complete search history.

(56) References Cited

U.S. PATENT DOCUMENTS 4,962,551 A * 10/1990 Bly ..... 4/480
5,095,556 A * 3/1992 Franey ..... 4/460
5,265,285 A * 11/1993 Loebbert ..... 4/484
5,903,932 A 5/1999 Whitesel
6,341,386 B1 1/2002 Phillips
6,385,790 B1 5/2002 Abraham
2002/0178496 A1 * 12/2002 Benkhardt ..... 4/661
2003/0167563 A1 * 9/2003 Hinton ..... 4/484

* cited by examiner

*Primary Examiner*—Khoa D. Huynh
*Assistant Examiner*—Kristie A. Mahone

(57) ABSTRACT

A toddler's and children's portable potty is disclosed. The portable potty has four adjustable legs and a removable bag holder ring which holds a disposable bag for one-time use. The portable potty can easily be transported with an included carrying case.

4 Claims, 3 Drawing Sheets

PORTABLE TRAVEL POTTY

I. BACKGROUND OF THE INVENTION

The present invention concerns that of a new and improved toddler's and children's portable potty.

II. DESCRIPTION OF THE PRIOR ART

U.S. Pat. No. 6,385,790, issued to Abraham, discloses a portable toilet device comprised of a seat and waste collecting bag capable of being supported by a number of legs.

U.S. Pat. No. 6,341,386, issued to Phillips, discloses a portable potty comprised of a plurality of folding legs to support a seat assembly and means to hold a disposable bag.

U.S. Pat. No. 5,903,932, issued to Whitesel, discloses a portable toilet seat for a child, having a liner for providing toilet training while away from home.

III. SUMMARY OF THE INVENTION

The present invention concerns that of a new and improved toddler's and children's portable potty. The portable potty has four adjustable legs and a removable bag holder ring which holds a disposable bag for one-time use. The portable potty can easily be transported with an included carrying case.

There has thus been outlined, rather broadly, the more important features of a portable potty that the detailed description thereof that follows may be better understood and in order that the present contribution to the art may be better appreciated. There are, of course, additional features of the portable potty that will be described hereinafter and which will form the subject matter of the claims appended hereto.

In this respect, before explaining at least one embodiment of the portable potty in detail, it is to be understood that the portable potty is not limited in its application to the details of construction and to the arrangements of the components set forth in the following description or illustrated in the drawings. The portable potty is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present portable potty. It is important, therefore, that the claims be regarded as including such equivalent constructions insofar as they do not depart from the spirit and scope of the present invention.

It is therefore an object of the present invention to provide a portable potty which has all of the advantages of the prior art and none of the disadvantages.

It is another object of the present invention to provide a portable potty which may be easily and efficiently manufactured and marketed.

It is another object of the present invention to provide a portable potty which is of durable and reliable construction.

It is yet another object of the present invention to provide a portable potty which is economically affordable and available for relevant market segment of the purchasing public.

Other objects, features and advantages of the present invention will become more readily apparent from the following detailed description of the preferred embodiment when considered with the attached drawings and appended claims.

IV. BRIEF DESCRIPTION OF THE DRAWINGS

V. DESCRIPTION OF THE PREFERRED EMBODIMENT

Figure 1:
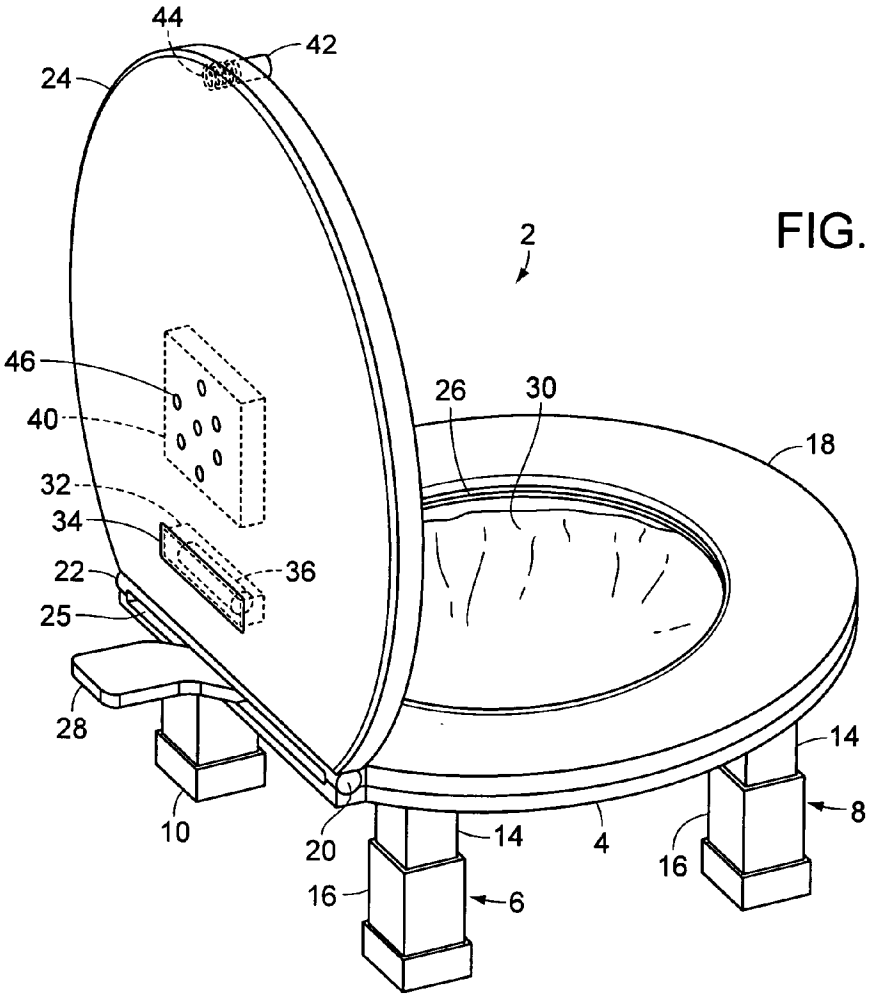
FIG. 1 shows a perspective view of the portable potty.
Figure 2:
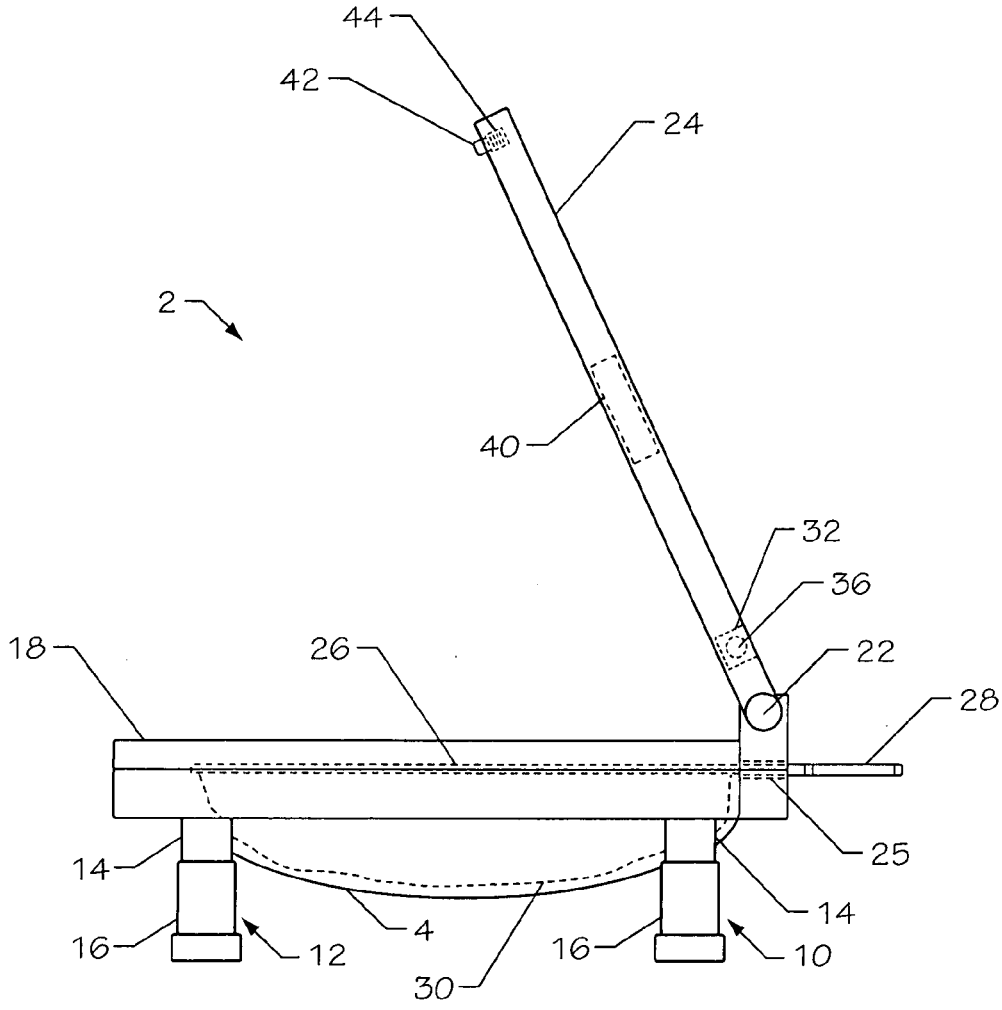
FIG. 2 shows a side view of the portable potty.

FIG. 1 shows a perspective view of the portable potty 2, while FIG. 2 shows a side view of the portable potty 2. Portable potty 2 comprises lower frame 4, which has two surfaces, a top surface and a bottom surface, and has two ends, a front end and a rear end. Lower frame 4 is shaped like an oval disc. Attached to the bottom surface of lower frame 4 are adjustable legs 6, 8, 10, and 12. Each of the legs have an upper section 14 and a lower section 16, with each upper section 14 telescoping within each lower section 16 when the portable potty 2 is placed in storage or not in use.

Lower seat 18 is shaped like an oval disc and has two ends, a front end and a rear end, and also has two surfaces, a top surface and a bottom surface. The rear end of lower seat 18 is pivotally attached to the top surface of the rear end of lower frame 4 in such a manner that only two end points 20 and 22 on lower seat 18 are actually pivotally attached to two points on the rear end of lower frame 4. In between the end points 20 and 22 is a thin slice 25 of open space.

Upper seat 24 has an oval shape and has two ends, a front end and a rear end, and also has two surfaces, a top surface and a bottom surface. The rear end of upper seat 24 is pivotally attached to the rear end of lower frame 4 above that of lower seat 18, thereby preserving the thin slice 25 of open space.

Bag holder ring 26 is shaped like an oval disc and has two ends, a front end and a rear end, and also has two surfaces, a top surface and a bottom surface. The rear end of bag holder ring 26 has handle 28. A disposable bag 30 is attached to the disc portion of bag holder ring 26 after bag holder ring 26 has been inserted through slot 25 of the portable potty 2. Slot 25 is located in between the lower seat 18 and the frame 4. The disposable bag 30 will temporarily hold any urine or feces from a toddler or child until it is thrown away by another individual.

Upper seat 24 has an incorporated music box 40 located within it, with a button 42 located on the lower surface of upper seat 24. The button 42 is normally pushed in when the upper seat 24 is a down position, with the button 42 resting against the top surface of the lower seat 18. When the upper seat 24 is opened up, an internal spring 44 pushes button 42 outward, activating the music box 40 to start playing tunes that are located within the music box 40. Sound is emitted through speaker 46, which is located on the top surface of upper seat 24.

Upper seat 24 has an incorporated battery compartment 32, accessible through a battery door 34 on the top surface of upper seat 24. Within battery compartment 32 is at least one battery 36 to provide power. Button 42 acts as a circuit in between the battery 36 and battery compartment 32 and the music box 40. When the button 42 is pressed in, the circuit is open. However, once the upper seat 24 is opened up, the button 42 is pushed outward by the action of spring 44, causing the circuit between the battery compartment 32 and battery 36 and music box 40 to close, thereby allowing the music box 40 to start playing music.

Figure 3:
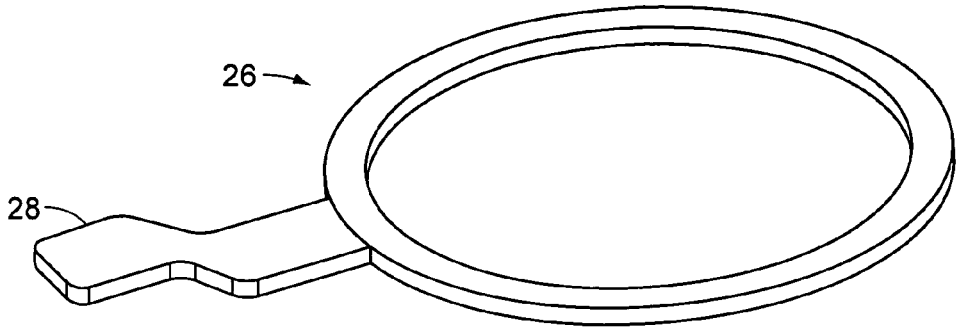
FIG. 3 shows a perspective view of the bag holder of the portable potty.

FIG. 3 shows a perspective view of the bag holder ring 26 of the portable potty, along with the incorporated handle 28. Bag holder ring 26 is inserted through the thin slice 25 of space and afterward, a disposable bag 30 would be attached to the disc portion of it for use by a toddler or small child.

Figure 4:
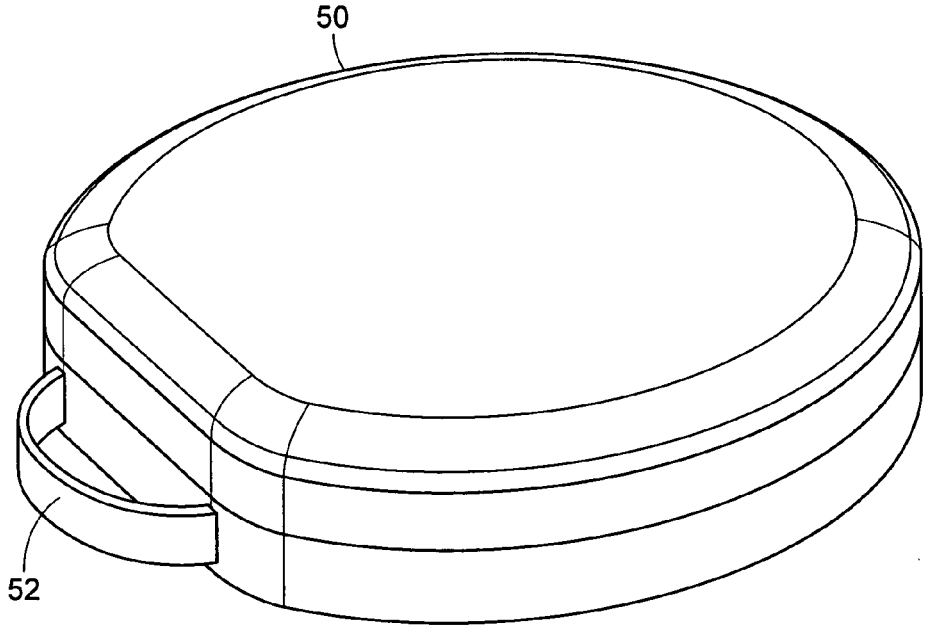
FIG. 4 shows a perspective representational view of the carrying case of the present invention.

FIG. 4 shows a perspective representational view of the carrying case 50 of the present invention. Carrying case 50 has an incorporated handle 52 to make sure that an individual could easily transport the portable potty 2 as needed.

What I claim as my invention is:

1. A portable potty comprising:

a lower frame having a top surface, a bottom surface, a front end, and a rear end, the lower frame being shaped like an oval disc, a plurality of adjustable legs, each adjustable leg having an upper section and a lower section, the upper section of each adjustable leg telescoping within the lower section of the adjustable leg, a lower seat having a top surface, a bottom surface, a front end, and a rear end, the lower seat being shaped like an oval disc, the rear end of the lower seat being pivotally attached to the top surface of the rear end of the lower frame, an upper seat having a top surface, a bottom surface, a front end, and a rear end, the upper seat being shaped like an oval disc, the rear end of the upper seat being pivotally attached to the lower frame, a slot formed in between the bottom surface of the lower seat and the top surface of the lower frame near the rear end of the lower seat and the upper seat, means for containing body waste, the means for containing body waste further comprises a bag holder ring having a front end, a rear end, a top surface, and a bottom surface, a handle attached to the rear end of the bag holder ring extending beyond the rear end of the lower frame, the lower seat, and the upper seat, a disposable bag attached to the bag holder ring, wherein the bag holder ring is inserted through the slot, a music box incorporated into the upper seat, power means for providing power to the music box, and a button attached to the bottom surface of the upper seat, the button acting as a circuit in between the music box and the power means, wherein the button is normally in a pushed-in position when the upper seat is placed down on the top surface of the lower seat, and further wherein the button is normally in a pushed-out position when the upper seat is placed in an upward position, further wherein the button is an open circuit when the button is pushed in and the button is a closed circuit when the button is pushed out, wherein opening the upper seat of the portable potty causes the music box to activate and play music.

2. A portable potty according to claim 1 wherein the power means for providing power to the portable potty is at least one battery.

3. A portable potty according to claim 1 wherein the plurality of adjustable legs preferably numbers four adjustable legs.

4. A portable potty according to claim 1 in combination with a carrying case.

* * * * *